US008185365B2

(12) United States Patent
Centala et al.

(10) Patent No.: US 8,185,365 B2
(45) **Date of Patent: *May 22, 2012**

(54) RADIAL FORCE DISTRIBUTIONS IN ROCK BITS

(75) Inventors: Prabhakaran K. Centala, The Woodlands, TX (US); Mohammed Boudrare, Houston, TX (US); Sujian Huang, Houston, TX (US)

(73) Assignee: Smith International, Inc., Houston, TX (US)

( * ) Notice: Subject to any disclaimer, the term of this patent is extended or adjusted under 35 U.S.C. 154(b) by 1037 days.

This patent is subject to a terminal disclaimer.

(21) Appl. No.: 10/809,276

(22) Filed: Mar. 25, 2004

(65) Prior Publication Data

US 2004/0254664 A1 Dec. 16, 2004

Related U.S. Application Data

(60) Provisional application No. 60/458,075, filed on Mar. 26, 2003.

(51) Int. Cl.
*G06G 7/48* (2006.01)
*E21B 7/00* (2006.01)

(52) U.S. Cl. ..... 703/7; 175/57; 703/10

(58) Field of Classification Search ..... 703/2, 6, 703/10, 7; 175/40, 57
See application file for complete search history.

(56) References Cited

U.S. PATENT DOCUMENTS

| | | | | |
|---|---|---|---|---|
| 5,165,494 | A * | 11/1992 | Barr | 175/376 |
| 5,427,531 | A * | 6/1995 | Kramer | 434/302 |
| 5,937,958 | A * | 8/1999 | Mensa-Wilmot et al. | 175/398 |
| 6,021,859 | A | 2/2000 | Tibbitts et al. | |
| 6,039,131 | A * | 3/2000 | Beaton | 175/376 |
| 6,412,577 | B1 * | 7/2002 | Chen | 175/57 |
| 6,516,293 | B1 * | 2/2003 | Huang et al. | 703/10 |
| 6,695,073 | B2 * | 2/2004 | Glass et al. | 175/40 |
| 6,785,641 | B1 * | 8/2004 | Huang | 703/7 |
| 2001/0020551 | A1 | 9/2001 | Taylor et al. | |
| 2001/0020552 | A1 * | 9/2001 | Beaton et al. | 175/385 |
| 2001/0042642 | A1 | 11/2001 | King | |
| 2002/0125047 | A1 * | 9/2002 | Beaton | 175/406 |
| 2002/0157869 | A1 | 10/2002 | Glass et al. | |
| 2002/0195276 | A1 * | 12/2002 | Dubinsky et al. | 175/40 |
| 2003/0051918 | A1 * | 3/2003 | Chen | 175/57 |

FOREIGN PATENT DOCUMENTS

WO WO01/33027 A3 5/2001

OTHER PUBLICATIONS

"The Operational Mechanics of the Rock Bit", Ma et al, Petroleum Industry Press, Copyright 1996.*

(Continued)

*Primary Examiner* — Kamini S Shah
*Assistant Examiner* — Akash Saxena
(74) *Attorney, Agent, or Firm* — Osha Liang LLP

(57) ABSTRACT

A method for designing a drill bit in an earth formation, including defining parameters for a simulation of the drill bit drilling in earth formation, where the parameters comprise at least bit design parameters; executing the defined simulation; obtaining radial forces resulting from the executing of the defined simulation; applying a criterion to the obtained radial forces; and adjusting one of the at least bit design parameters in response to the applying of the criteria.

39 Claims, 14 Drawing Sheets

OTHER PUBLICATIONS

"The Computer Simulation of the Interaction Between Roller Bit and Rock", Ma et al, SPE 29922, SPE 1995.*
Drag Bit Wear Model A. Slnor, SPE, and T.M. Wanen, SPE, Amoco Production Co., SPE 1989; p. 128-136.*
Canadian Office Action issued in Application No. 2462340 dated Apr. 3, 2006.
Canadian Application No. 2462340; Office Action issued by the Canadian Intellectual Property Office dated Jul. 10, 2007, 2 pages.

* cited by examiner

Ratio of Force H to WOB

Ratio of Force H to WOB

Ratio of Force H to WOB

Ratio of Lateral Force to WOB

RADIAL FORCE DISTRIBUTIONS IN ROCK BITS

CROSS-REFERENCE TO RELATED APPLICATIONS

This is an utility application, which claims priority to U.S. Provisional Application No. 60/458,075, filed on Mar. 26, 2003.

BACKGROUND OF INVENTION

Roller cone rock drill bits and fixed cutter drill bits are commonly used in the oil and gas industry for drilling wells. FIG. 1 shows one example of a conventional drilling system drilling an earth formation. The drilling system includes a drilling rig 10 used to turn a drill string 12 which extends downward into a well bore 14. Connected to the end of the drill string 12 is a bottomhole assembly, which includes at least a drill bit 20 that cuts through and breaks up earth formation as it is rotated.

One example of a roller cone-type drill bit is shown in FIG. 2. Roller cone bits 20 typically comprise a bit body 22 having an externally threaded connection at one end 24, and a plurality of roller cones 26 (usually three as shown) attached to the other end of the bit and able to rotate with respect to the bit body 22. Attached to the cones 26 of the bit 20 are a plurality of cutting elements 28 typically arranged in rows about the surface of the cones 26. The cutting elements 28 are typically tungsten carbide inserts, polycrystalline diamond compacts, or milled steel teeth.

Significant expense is involved in the design and manufacture of drill bits. Therefore, having accurate models for simulating and analyzing the drilling characteristics of bits can greatly reduce the cost associated with manufacturing drill bits for testing and analysis purposes. For this reason, several models have been developed and employed for the analysis and design of fixed cutter bits. These fixed cutter simulation models have been particularly useful in that they have provided a means for analyzing the forces acting on the individual cutting elements on the bit.

However, roller cone bits are more complex than fixed cutter bits in that each roller cone independently rotates relative to the rotation of the bit body about axes oblique to the axis of the bit body. Additionally, the cutting elements of the roller cone bit deform the earth formation by a combination of compressive fracturing and shearing, whereas fixed cutter bits typically deform the earth formation substantially entirely by shearing. Because each roller cone independently rotates about an axis oblique to the axis of the bit body, a conventional rock bit may experience unbalanced lateral forces (radial forces) that cause the rock bit to gyrate or laterally bounce about the bottom hole and impact the wall of the wellbore during drilling. This type of bit motion is generally referred to as bit gyration or "whirling." Bit whirling is an undesirable performance characteristic, because it results in inefficient drilling of the bottomhole and can potentially damage the bit prematurely.

Accurate analysis of the drilling performance of roller cone bits requires more complex models than for fixed cutter bits. Until recently, no reliable roller cone bit models had been developed which could take into consideration the location, orientation, size, height, and shape of each cutting element on the roller cone, and the interaction of each individual cutting element on the cones with earth formations during drilling.

In recent years, some researchers have developed a method for modeling roller cone cutter interaction with earth formations. See D. Ma et al, *The Computer Simulation of the Interaction Between Roller Bit and Rock*, paper no. 29922, Society of Petroleum Engineers, Richardson, Tex. (1995). However, methods have not been specifically developed for optimizing the performance of drill bits, particularly, roller cone bits, in drilling earth formations to analyze bit performance with respect to the lateral (radial) force of the bits. To produce new and improved bits designed to exhibit desirable drilling characteristics, such as minimized bit whirl or a later walk tendency, such methods are desired and may be used. Bit specifically designed to exhibit reduced whirling tendencies may drill more efficiently with increased longevity maximizing the drilling performance of a given bit.

SUMMARY OF INVENTION

In general, one aspect of the invention relates to a method for designing a drill bit. The method includes defining parameters for a simulation of the drill bit drilling in an earth formation, where the parameters include at least bit design parameters; executing the defined simulation; obtaining radial forces resulting from the executing of the defined simulation; applying a criterion to the obtained radial forces; and adjusting one of the at least bit design parameters in response to the applying of the criterion.

In general, one aspect of the present invention relates to a method for designing a bottomhole assembly. The method includes defining parameters for a simulation of a drilling tool assembly drilling in an earth formation, where the parameters include at least bottomhole assembly design parameters; executing the defined simulation; obtaining radial forces resulting from the executing of the defined simulation; applying a criterion to the obtained radial forces to evaluate the drill tool assembly performance; and adjusting one of the at least bottomhole assembly design parameters in response to the applying of the criterion.

In general, one aspect of the present invention relates to a method for designing a bit. The method includes defining parameters for a simulation of the drill bit drilling in an earth formation, where the parameters include at least bit design parameters; executing the defined simulation; graphically displaying radial forces resulting from the executing of the defined simulation; applying a criterion to the graphically displayed radial forces; and adjusting one of the at least bit design parameters in response to the applying of the criterion.

In general, one aspect of the present invention relates to a method for selecting an optimal bit design. The method includes simulating a first bit design drilling in earth formation; obtaining radial forces resulting from the simulating of the first bit design; applying a criterion to the obtained radial forces of the first bit design; and adjusting one of the at least bit design parameters in response to the applying of the criteria to the first bit design to generate a second a second bit design; simulating the second bit design; obtaining radial forces resulting from the simulating of the second bit design; applying the criterion to the obtained forces of the second bit design; and comparing the first bit design and the second bit design with respect to the criterion; and selecting the optimal bit design of the first bit design and the second bit design.

In general, one aspect of the invention relates to a system for simulating a drill bit drilling in an earth formation. The system includes means for defining parameters for a simulation of the drill bit drilling in earth formation, wherein the parameters includes at least bit design parameters; means for executing the defined simulation; means for obtaining radial forces resulting from the executing of the defined simulation; means for applying a criterion to the obtained radial forces;

and means for adjusting one of the at least bit design parameters in response to the applying of the criterion.

Other aspects and advantages of the invention will be apparent from the following description and the appended claims.

DETAILED DESCRIPTION

The present invention relates to methods for designing drill bits based on radial forces obtained from a simulation of the drill bit drilling an earth formation.

In one aspect, a method for designing a drill bit includes obtaining radial forces on the drill bit, comparing an aspect of the radial forces to at least one selected criteria, and adjusting a drill bit design based on an evaluation of the radial forces with respect to the selected criteria. In another aspect, the method may be adapted and used for designing a drilling tool assembly that includes a bottomhole assembly, where the design of the bottom hole assembly or just the bit may be adjusted based on the evaluation. In another aspect, the invention relates to drill bits and drilling tool assemblies designed in accordance with methods disclosed.

Radial Forces

Figure 8:
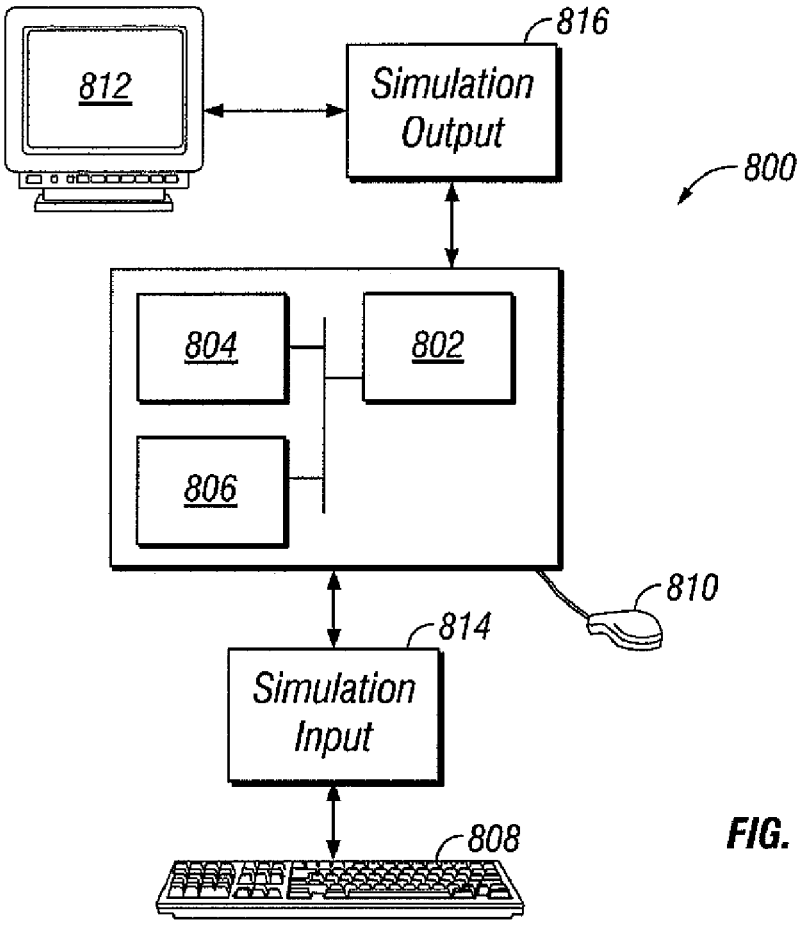
FIG. 8 shows a computer system in accordance with an embodiment of the present invention.

As used herein, "radial forces" on the drill bit are the forces (or component of the forces) acting on the bit in a plane perpendicular to the bit axis. FIG. 8 shows one example of radial forces acting on a drill bit due to interference with a wall of a borehole. The drill bit 302, in the present example, is a roller cone drill bit having a cutting structure that includes three cones 302 A, 302 B, and 302 C. The earth formation 304 is fractured and sheared by the cutting elements (not shown) of the cone 302 A. Consequently, the shearing and fracturing of the earth formation 304 produces reaction forces in the vertical and radial directions. In particular, radial forces acting on a drill bit 302 tend to swing the drill bit 302 away from a borehole axis. For example, in FIG. 8, because of the radial force 306 (or reaction force 308) on cone 302 A, the drill bit 302 will swing away from the borehole axis 300 thereby causing a "swinging" or "whirl" effect about the borehole axis. This motion about the borehole axis is referred to as "bit whirl." Bit whirl may reduce the efficiency of a drill bit's performance with respect to the rate of penetration (ROP) and footage drilled by the drill bit. Further, bit whirl may damage cutting structure of the drill bit, leading to premature failure of the gage inserts and seals, and reduce the drill bit life. While bit whirl has been discussed above with respect to a roller cone drill bit, all bits can experience some sort of bit whirl. Furthermore, bit whirl during drilling does not only effect the drill bit, but can also have a detrimental effect on the BHA and the drill pipe of a drilling tool assembly.

Method of Designing

Obtaining Radial Forces

Figure 1:
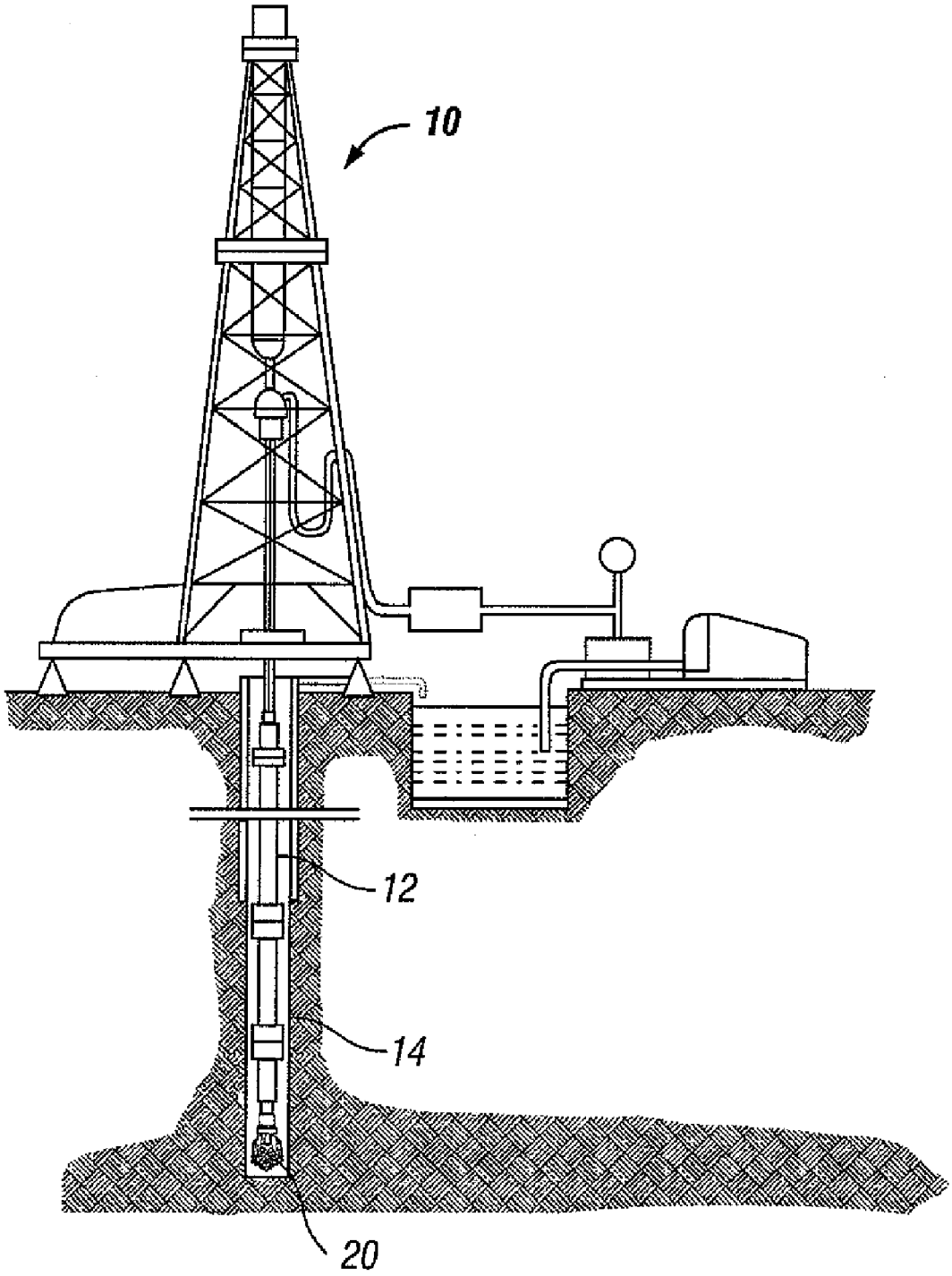
FIG. 1 (Prior Art)
FIG. 1 shows a schematic diagram of a drilling system for drilling earth formations having a drill string attached at one end to a bit.
Figure 2:
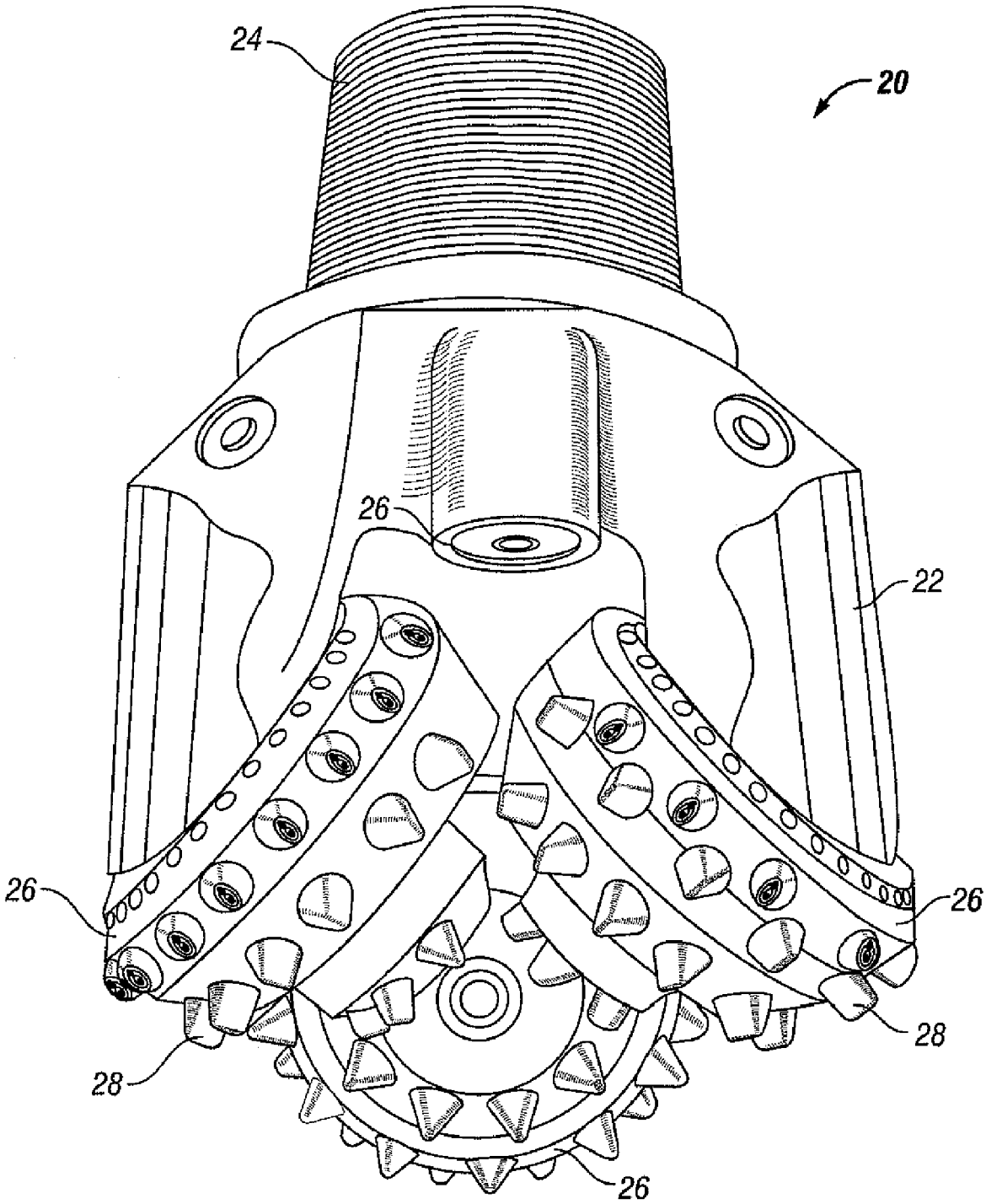
FIG. 2 (Prior Art)
FIG. 2 shows a perspective view of a roller cone drill bit.
Figure 3:
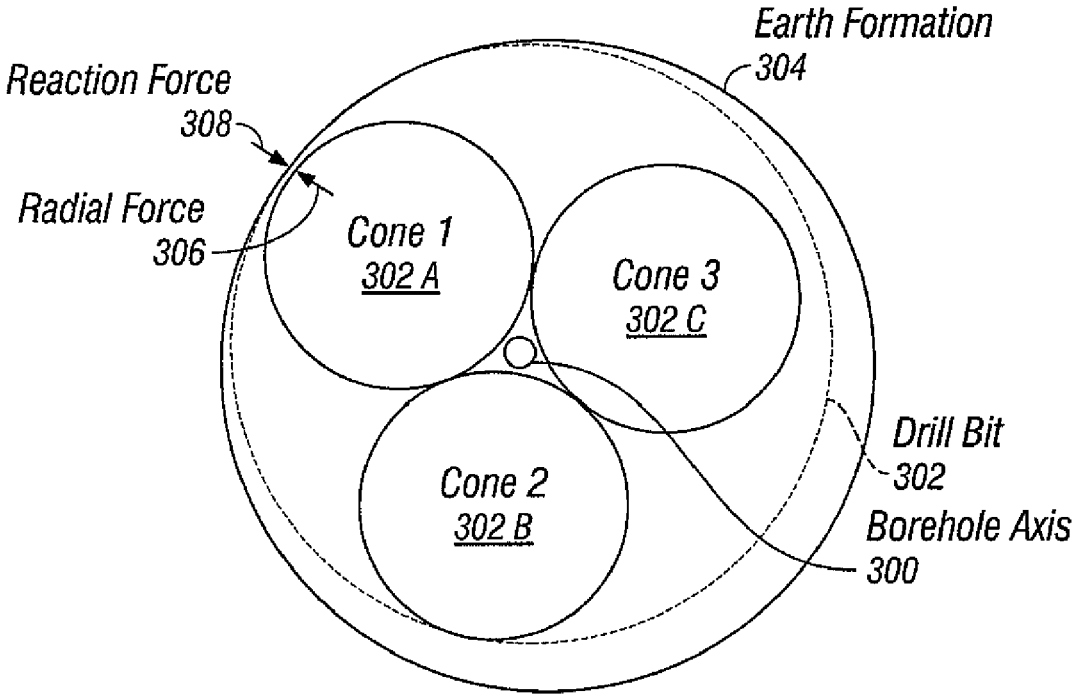
FIG. 3 shows a diagram of resultant radial forces for a bit interfering with earth formations during drilling.
Figure 4:
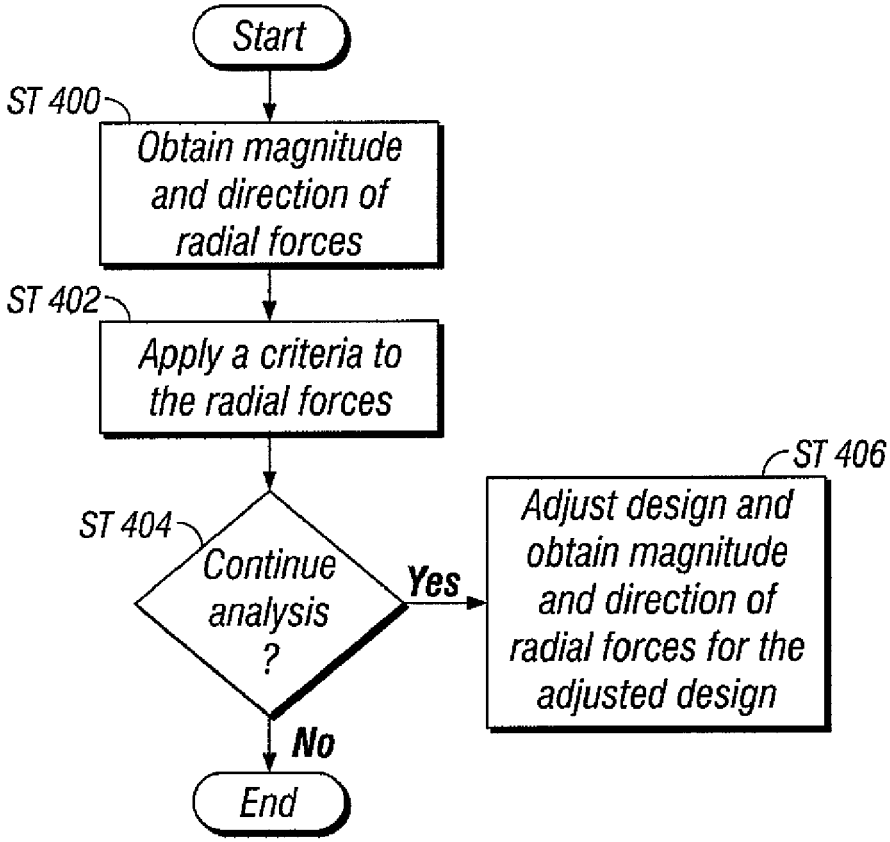
FIG. 4 shows a flow diagram of a method of designing a drill bit in accordance with an embodiment of the present invention.

One embodiment of the present invention is now described with respect to FIG. 4. In this embodiment, a method for designing a drill bit includes obtaining magnitude and direction of radial forces for a drill bit (Step 400), applying a criteria to the radial forces (Step 402), and evaluating drill bit performance based on the criteria (Step 404), adjusting at least one design parameter for the drill bit (Step 406) and repeating the steps of obtaining (Step 400), applying (Step 402), and evaluating (Step 404) until at least the drill bit design satisfies the criteria or the drill bit design is considered by the designer to be best in view of the criteria. This embodiment will now be further described below.

Initially, magnitudes and directions of resultant radial forces acting on a selected drill bit drilling in earth formation are obtained (Step 400). These resultant radial forces may be obtained in a variety of ways, such as, from a simulation of a drill bit drilling in an earth formation. One example of a simulation method that may be used to determine resultant radial forces acting on a drill bit during drilling is disclosed in U.S. Pat. No. 6,516,293, issued on Feb. 4, 2003, entitled, "Method for Simulating Drilling of Roller Cone Bits and its Application to Roller Cone Bit Design and Performance," assigned to the assignee of the present invention and incorporated herein by reference in its entirety. Other methods are known in the art for simulating the response of a roller cone drill bit and may, alternatively, be used.

The resultant radial forces may be obtained in a lab test simulation involving a drill bit structure drilling an earth formation sample, where the resultant radial forces are measured using sensors coupled to the drill bit or in a surface representative of a borehole wall.

Output of Radial Forces

Figure 5:
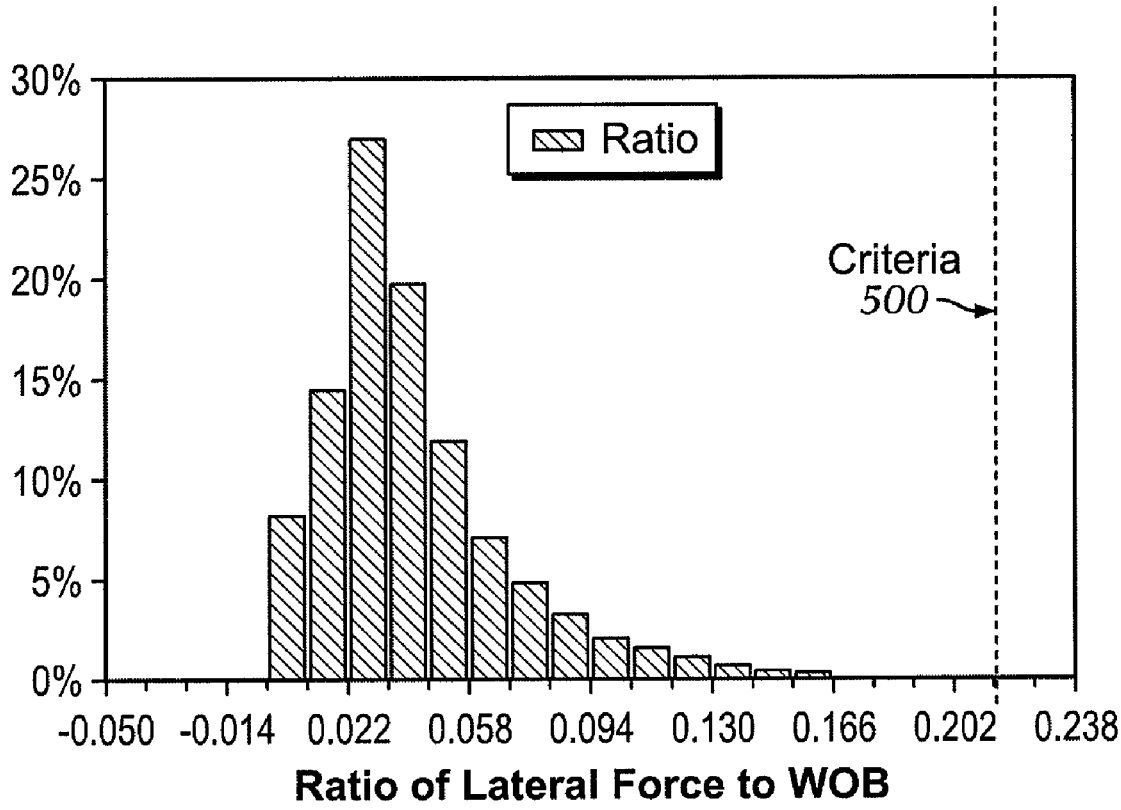
FIGS. 5 and 6 show exemplary distribution chart plots of radial force in accordance with an embodiment of the present invention.
Figure 7:
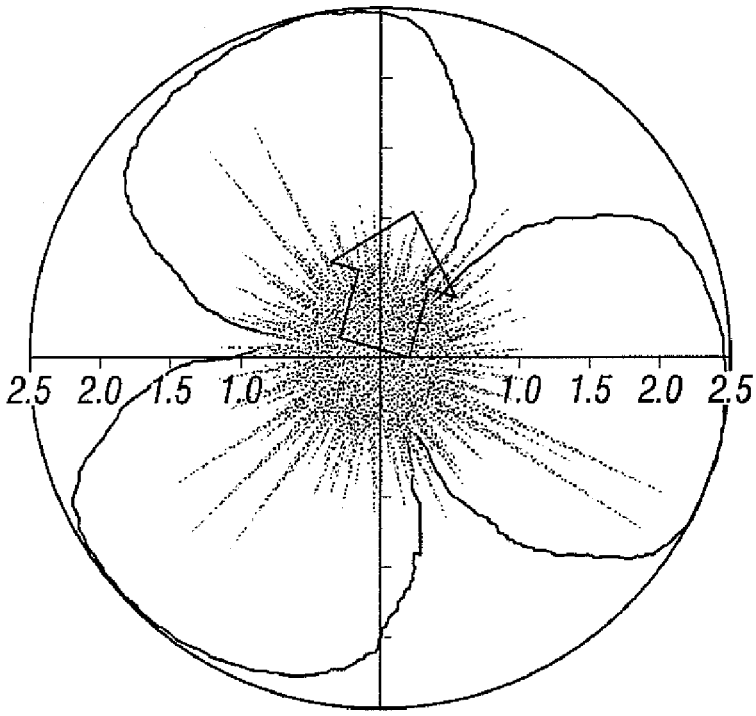
FIG. 7 shows an exemplary distribution polar plot of radial force in accordance with an embodiment of the present invention.
Figure 9B:
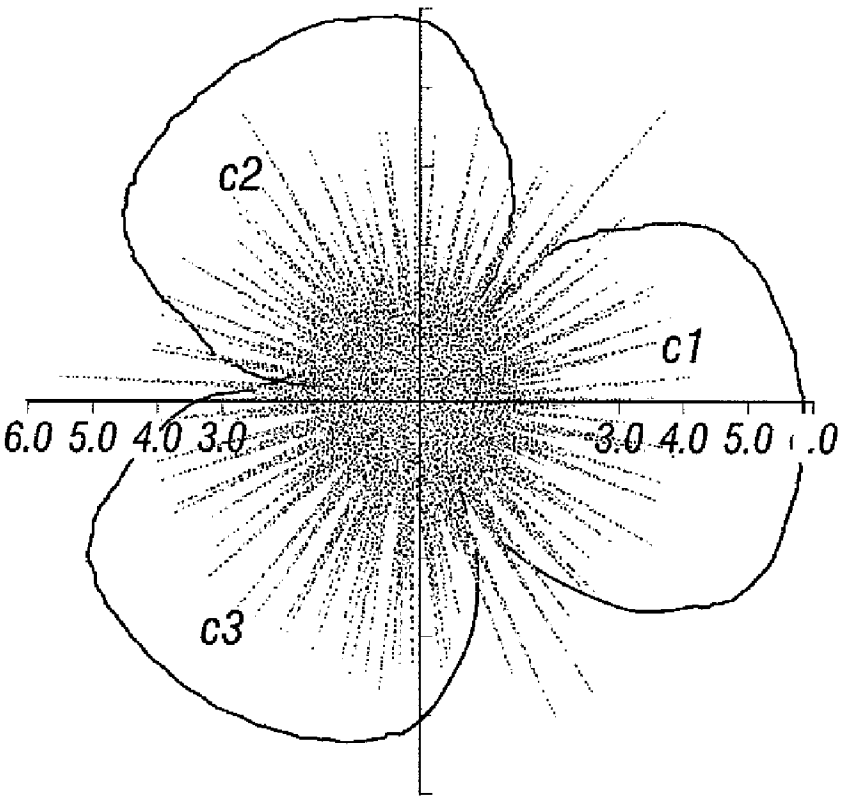
FIGS. 9A-9C show exemplary distribution polar plots of radial force of iterations of an optimized bit design in accordance with an embodiment of the present invention.
Figure 9A:
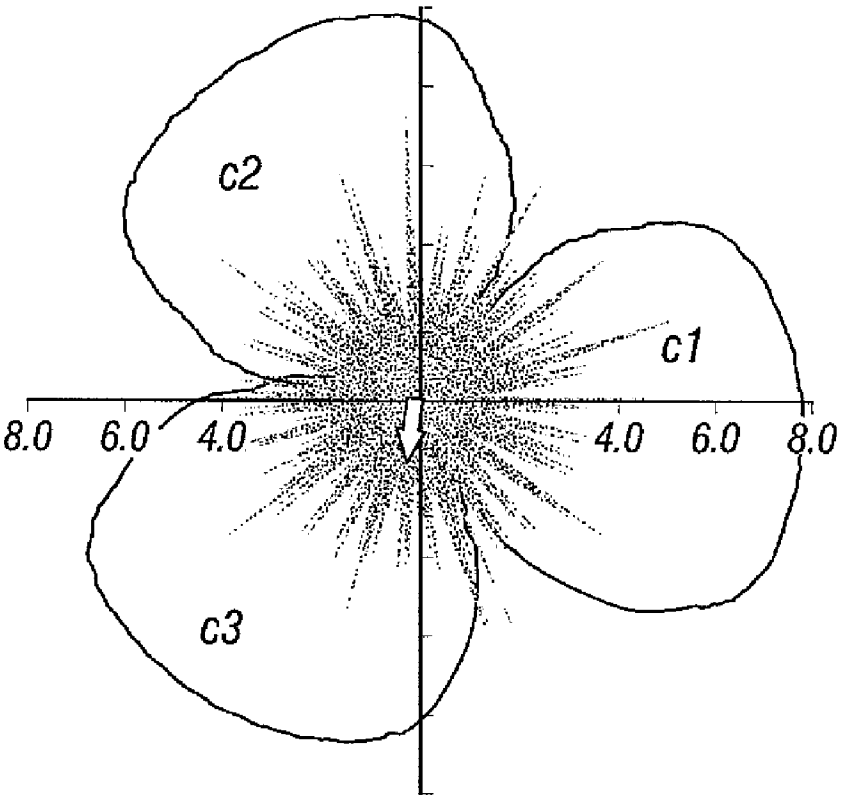

The radial forces obtained may be represented in a variety of different forms as determined by a bit or system designer. For example, radial forces obtained during a simulation may be summarized in tables, graphs, plots, etc. Examples of tables and graphs include tabular or graphical representations of resultant radial force versus time during drilling. Examples of graphs or plots include a bar chart showing the distribution of resultant force magnitudes during drilling, a box-whisker plot showing the statistical distribution of radial forces, a polar plot showing the distribution of the radial forces about the drill bit or bottomhole, etc. Examples of a bar chart, a polar plot, and a box-whisker plot, are shown in FIGS. 5, 7, and 9A.

Applying Criteria

After resultant radial forces are obtained for a given bit design, a criteria is applied to the resultant radial forces (Step 402). The criteria may be any standard by which radial force on a bit can be evaluated. The criteria may be quantitative or qualitative in nature, or a combination thereof.

For example, a criteria may be a ratio of the resultant radial force to the applied weight on bit (WOB). In one example, the criteria is that the ratio is, preferably, no more than about 0.20, i.e., the resultant radial force is less than or equal to twenty percent of the applied weight on bit. In other words, at any given time during drilling the resultant radial force should not exceed 20% of the WOB. One skilled in the art will appreciate that bit performance may be improved as a ratio of the resultant radial force to an applied weight-on-bit is minimized. Thus, in a preferred embodiment of the present invention the resultant radial force is less than or equal to 10% of the WOB, and more preferably, the resultant radial force is less than or equal to 5% of the WOB.

FIG. 5 provides an example of an application of a criteria in accordance with one or more embodiments of the present invention. FIG. 5 shows a chart plot of a distribution of ratios of resultant radial force to an applied weight on bit. The chart plot enumerates the occurrences of a ratio of the resultant radial force to the applied weight-on-bit. The frequency of occurrences in the present chart plot is presented on the Y-axis as percentages of total drilling time. The ratios between the resultant radial force and the applied weight-on bit are presented on the X-axis in decimal form, i.e., fractions of the radial force to the applied weight-on-bit.

In FIG. 5, the most frequently occurring ratio is about 0.022, which was seen about 26% of the time during the simulated drilling. In other words, the resultant radial force exerted by the bit was approximately 2.2% of the applied weight-on-bit for about a quarter of the time during the simulated drilling.

The criteria (500) applied to the radial forces obtained for a drill bit is illustrated on the chart plot as an upper limit ratio of 0.200 (indicated by the dotted line). In this example, the criteria applied to the chart plot of resultant radial force, preferably, requires that a ratio of resultant radial force to the applied weight-on-bit is less than 0.200 during the time spent drilling. An additional criteria may be applied that the frequency of the smaller ratios (ratios below a selected value) be maximized with respect to the total distribution. This additional criteria may be used to evaluate the extent to which the larger radial forces are minimized if the first criteria is not met.

Figure 13:
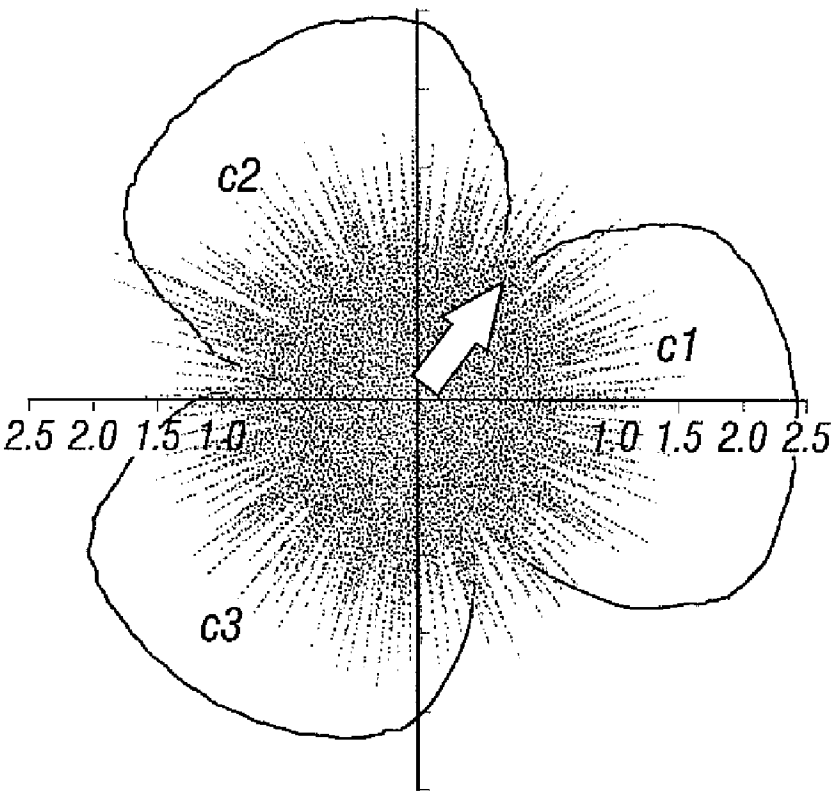
FIG. 13 shows an exemplary distribution polar plot of radial force for a bit design with an unskewed distribution in accordance with an embodiment of the present invention.

Another example of a criteria is that a magnitude of a resultant radial force is less than a predetermined value. In other words, at any given time during drilling the resultant radial force should not exceed a predetermined value. In another example, the criteria may be that a magnitude of the resultant force is less than a predetermined value for a selected percentage of the time spent drilling. For example, in one embodiment, the magnitude of the lateral forces is less than a predetermined value for 70% of the time of simulated drilling. One skilled in the art will appreciate that the predetermined value may depend on the WOB, type of formation, drill bit design (i.e., orientation of the cutting elements), or the geometry of the cutting element, etc. Again, the criteria may be numerically applied to radial force values output from a simulation or applied to graphical representation of resultant radial forces, such as, graphs and/or plots. In a polar plot of resultant radial force, as shown in FIG. 13, a criteria of magnitude may be applied as a circle of a predetermined radius, where the resultant radial forces are desired to be within the bounds of the circle.

Alternatively, a criteria may be applied qualitatively to the resultant radial forces obtained during the simulation method. For example, a criteria may be a predetermined radial force pattern desired for a polar plot, such as the one shown in FIG. 7. One example of a predetermined radial force pattern desired may be an even distribution of radial forces about the drill bit axis during drilling. FIG. 7 is one example of a distribution polar plot of radial force in accordance with an embodiment of the present invention. An instantaneous resultant radial force is indicated in this figure by the emboldened arrow. The magnitude and direction of the instantaneous force is indicated by the size and orientation of the emboldened arrow, respectively.

The manner in which the cutting structure and bit body interacts with the earth formations during a given instant in drilling produces the instantaneous resultant radial force (the emboldened arrow). The resultant radial forces determined at previous increments of drilling are shown as "foot prints" on the plot as smaller vectors. The polar plot may be compared against a predetermined desired radial force pattern, such as, an even distribution of radial forces of relatively small magnitudes about the origin of the polar plot.

Adjusting Design

Referring back to FIG. 4, if the resultant radial forces of the current bit design satisfy the selected criteria, then the design method may be concluded and the current bit design may be selected for manufacturing. However, if the resultant radial forces of the current bit design do not meet the selected criteria, then the drill bit design may be adjusted (Step 404). Alternatively, if the resultant radial forces of the current bit design do not meet the selected criteria, then the criteria may be adjusted or a new criteria selected at the designer's discretion.

The adjustment of various drill bit design parameters is largely based on the designer's discretion and/or experience. Preferably, modifications in the design are rendered to improve the performance with respect to a radial force imbalance. However, in other embodiments, a drill bit may be purposefully designed to produce a radially imbalanced, such as in a particular direction, for example, to obtain a design for a bit having a particular "walking" tendency. Examples of bit design parameters that may be adjusted include, but are not limited to, an arrangement of cutting element on a drill bit (which may be within a row or between rows), a number of cutting elements on a drill bit, a geometry of cutting elements on a drill bit, or orientation of cutting elements. For a given roller cone on a bit, bit design parameters additionally include a journal angle, cone profile, number of cutting elements on a row, a location of a row, and an arrangement of cutting elements on a cone, etc. Those skilled in the art will appreciate that numerous other design parameters of a bit may be adjusted in accordance with methods described herein.

After an adjustment is made to the drill bit design (Step 404), the new (or adjusted) bit design is simulated, and the resultant radial forces are obtained for the new bit design (Step 400). The new design is then evaluated based on the selected criteria. The design method may be repeated until a bit design satisfying a criteria is obtained or until the design method is terminated by the designer.

Selecting Design

A method in accordance with one embodiment shown in FIG. 7 may also be used to select a bit design. In one example, the design method is terminated when an applied criteria has not been satisfied in a selected number of iterations of the design method. In this case, the designer may terminate the design method and select one or more bit design that is "closest" (either subjectively or objectively) to satisfying the selected criteria.

Figure 6:
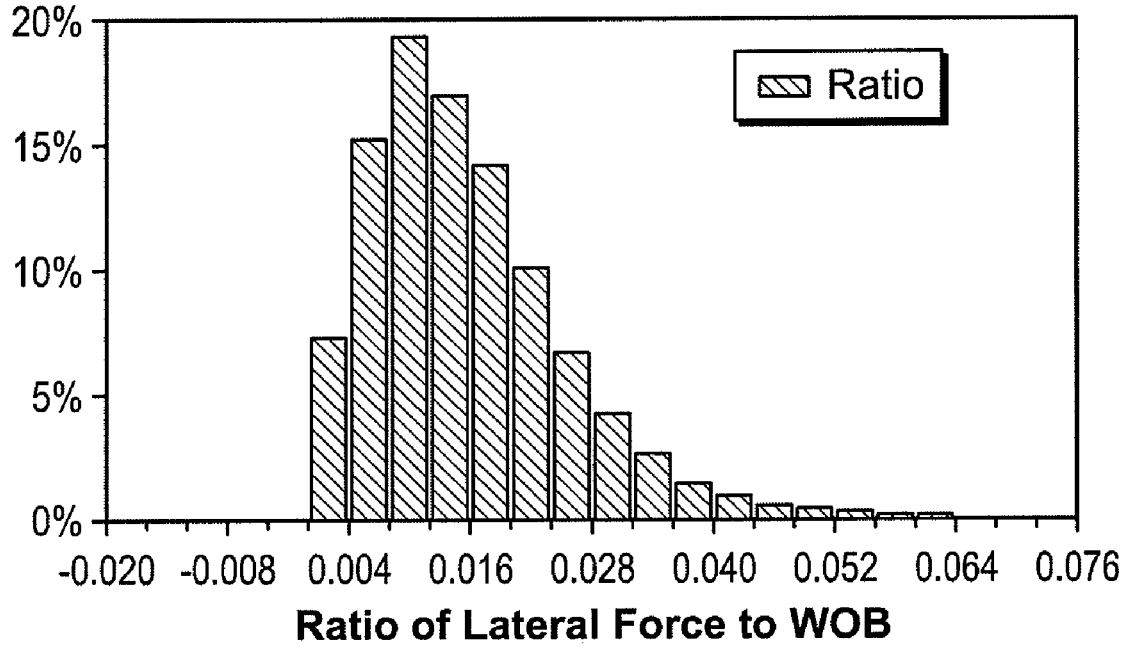

For example, referring to FIGS. 5 and 6, a selected criteria is applied during the design method may be that a ratio of resultant radial forces to WOB is less than or equal to about 0.05. After applying this criterion over several iterations of the design method, the designer terminates the design method. The drill bit designs corresponding to resultant forces shown in FIGS. 5 and 6 are selected as the designs that are closest to satisfying the selected criteria. These designs are then compared to determine a preferred design.

As previously discussed, FIG. 5 shows the most frequently occurring ratio is about 0.022 which correlates to about 26% of the time spent drilling. In other words, the resultant radial force exerted by the bit is approximately 2.2% of the applied weight-on-bit for about a quarter of the time spent drilling. The total frequency of the ratios that are less than or equal to about 0.05 are also considered.

FIG. 6 may be considered to show an improvement in bit performance relative to FIG. 5. In FIG. 6, the most frequently occurring ratio is about 0.008 which occurs about 19% of the time spent drilling, and the maximum resultant radial force is substantially smaller than that shown in FIG. 6. In general, the smaller ratios of FIG. 6 are maximized with respect to the total distribution in comparison to FIG. 5. Thus the drill bit design corresponding to the radial force record represented in FIG. 6 may be selected as the bit design of choice for manufacturing a drill bit.

Computer System for Designing

In one or more embodiments, the present invention may be implemented on virtually any type computer system regardless of the platform being used. For example, as shown in FIG. 8, a typical computer system 800 includes a processor/simulator 802, associated memory 804, a storage device 806, and numerous other elements and functionalities typical of today's computers (not shown). The computer system 800 may also include input means, such as a keyboard 808 and a mouse 810, and output means, such as a monitor 812. Those skilled in the art will appreciate that these input and output means may take other forms in an accessible environment.

In one or more embodiments, using the keyboard 808 and/or mouse 810, a user may input initial or modified set an of parameters known as simulation input 814. The initial or modified parameters are input to the system and used by the processor 802 (or simulator) to execute a simulation. The results of the simulation (or simulation output 816) in the form of graphics (computer-generated graphics of a bit, bottom hole profile, etc.), graphs (polar plots, box-whisker plots, chart plots, etc.), tables, etc. may be output from the computer system 800 and displayed on a monitor 812, for example. After reviewing the simulation on the monitor 812, a user may change a bit parameter using the mouse 810 and reinitiate a simulation of the design on the computer system 800.

Further, in one or more embodiments, the computer system 800 may include a software component, which provides Boolean (true or false) values for satisfying (or not) different quantitative radial force criterion. For example, after specifying the criteria and running the simulation to obtain radial force output, the software component may output a statement to the user, "No, this design does not meet the established criteria," and may provide values that indicate to the extent to which the selected criteria has not been satisfied. The system may be further configured to prompt the designer to change the criteria, modify the design, or terminate the design process.

One of ordinary skill in the art can appreciate that the computer system may be implemented in a variety of ways having a variety of software components for executing the design method of the present invention.

EXAMPLE

Another example of a method of designing a bit in accordance with an embodiment of the present invention will now be described with respect to FIGS. 9A-9C, 10A-10C, and 11A-11C. These figures show examples of resultant radial force output obtained from a simulation. The bit design is improved through several iterations, in accordance with the present invention. In this example, a simulation as described in U.S. Pat. No. 6,516,293, issued on Feb. 4, 2003 entitled, "Methods for Simulating Drilling of Roller Cone Drill Bits and its Application to Roller Cone Drill Bit Design and Performance," is used to obtain resultant radial forces as briefly described below with reference to FIG. 12.

Initially, parameters for the simulation are selected (Step 1200), which define the initial bit design, and the simulation begins by rotating the defined bit (Step 1202) to determine a new location of the cutting elements located on the bit (Step 1204). Interferences between the cutting elements and the earth formation are determined (Step 1206) and the vertical and/or radial forces are calculated (Step 1208). Based on the previous calculations, the appropriate parameters, such as the bottomhole geometry, etc. are updated (Step 1210) and the simulation continues in view of the removed earth formation, until a terminating condition is reached (Step 1212).

Figure 10A:
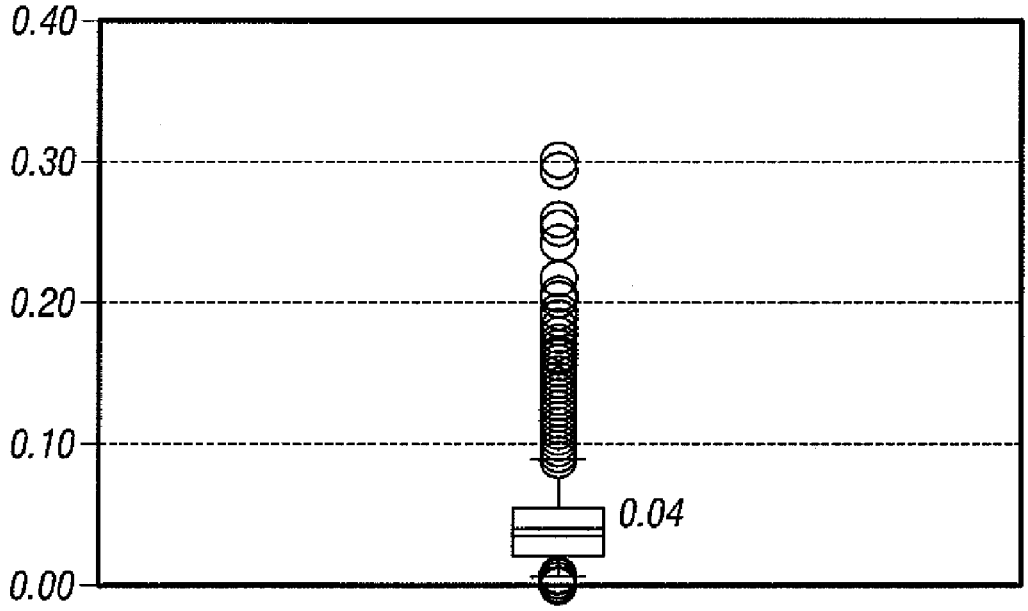
FIGS. 10A-10C show exemplary distribution chart plots of iterations of an optimized bit design in accordance with an embodiment of the present invention.
Figure 11A:
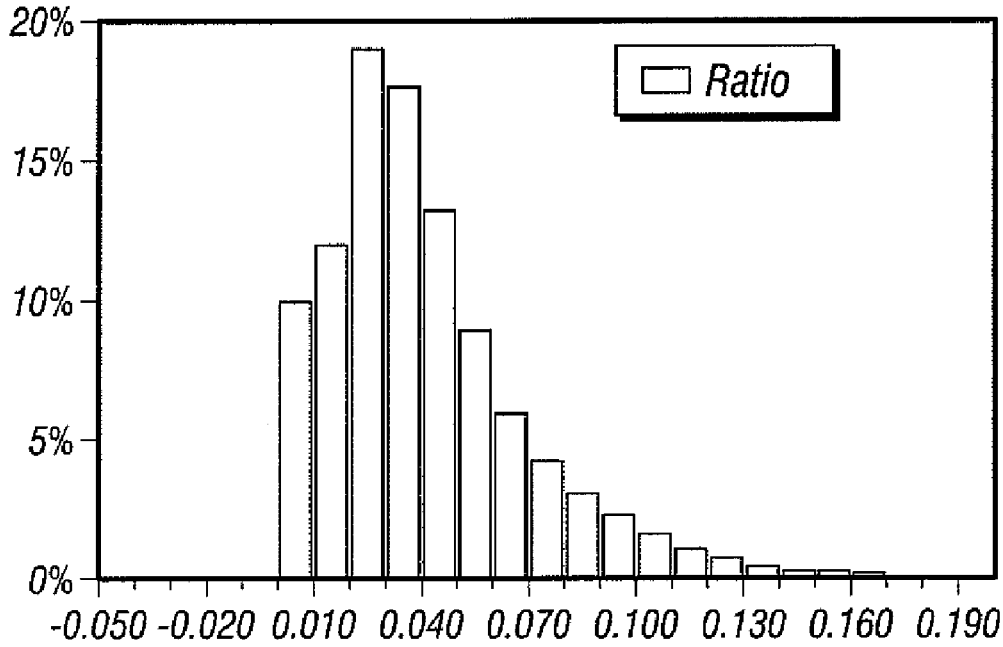
FIGS. 11A-11C show exemplary distribution box-whisker plots of iterations of an optimized bit design in accordance with an embodiment of the present invention.
Figure 12:
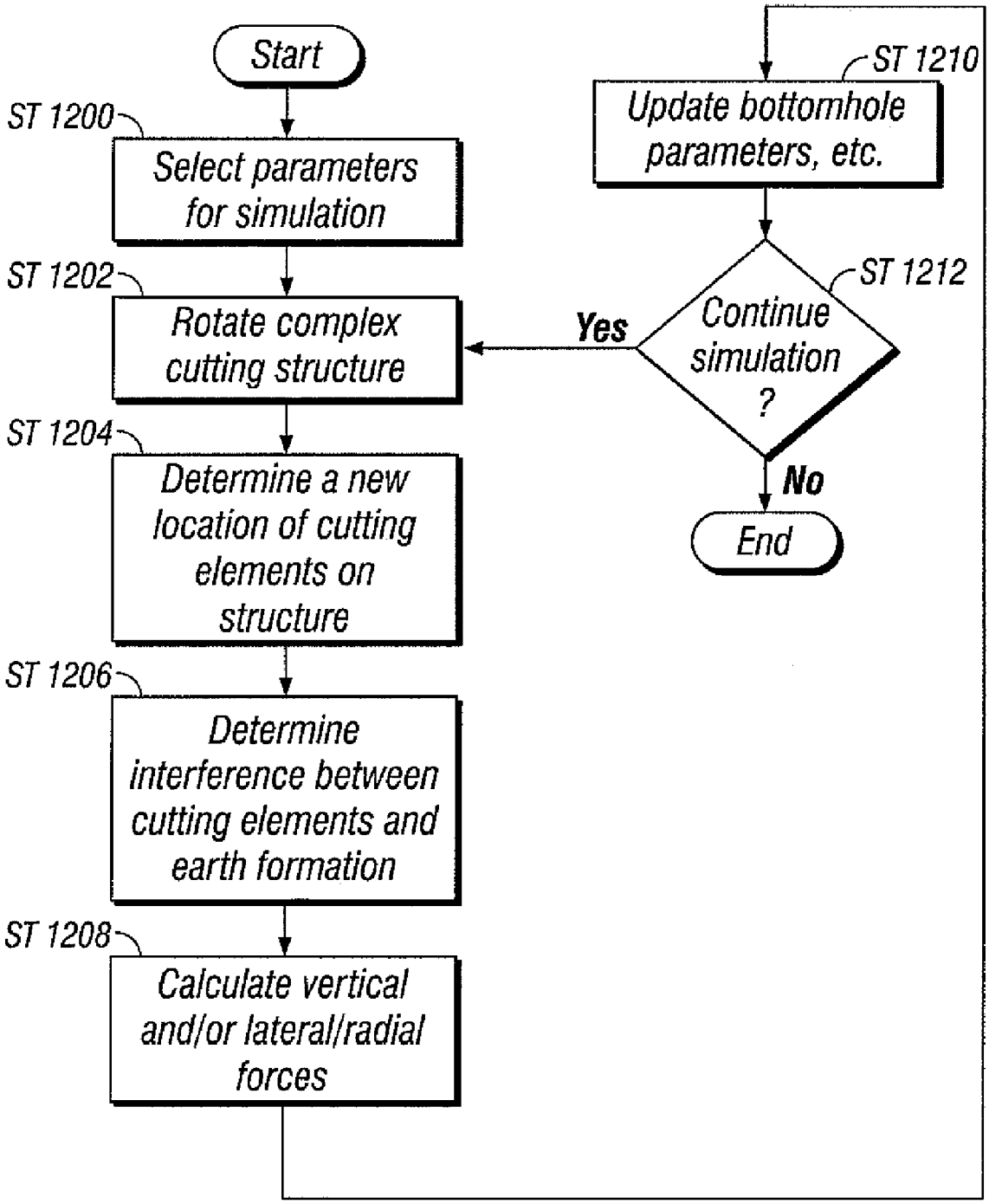
FIG. 12 shows an example of a simulation method in accordance with one embodiment of the present invention.

The calculated radial forces are obtained in a variety of forms. FIGS. 9A, 10A, and 11A show three different forms in which resultant radial force is output of a first bit design iteration. These different forms provide different perspectives of the resultant radial forces and can be used individually, or in combination to evaluate a drill bit design. In FIG. 9A, the radial force vectors are substantially evenly distributed between the three cones. Additionally, there are several outliers, i.e., radial forces, which are concentrated at a substantially large distances from the bit axis.

FIG. 10A shows a box-whisker plot of the first bit design iteration. In FIG. 10A, the mean (or average) ratio of the resultant radial force to the applied weight on bit during the first iteration is 0.04, i.e., the resultant radial force is 4.0% of the applied weight on bit. The standard deviation (where approximately 68% of the data points "fall," which is represented by the rectangle) of the bit during the first iteration shows the resultant radial force is approximately between 2% and 6% of the applied weight on bit. Further, the maximum value of the resultant radial force is 30% of the applied weight on bit.

The chart plot in FIG. 11A shows the most frequently occurring ratio is about 0.025, which correlates to about 18% of the time, spent drilling. In other words, the resultant radial force exerted by the bit is approximately 2.5% of the applied weight on bit for about 18% of the time spent drilling.

A quantitative radial force criteria is applied. For example, the criteria being that a resultant radial force is less than 20% of the WOB at any time during drilling. As seen in FIG. 10A, the maximum value of the resultant radial force is 30% of the applied WOB, thus, the first design does not meet the criteria as set forth by the designer. Therefore, the designer adjusts a drill bit design parameter, such as the cutting structure arrangement.

Figure 10B:
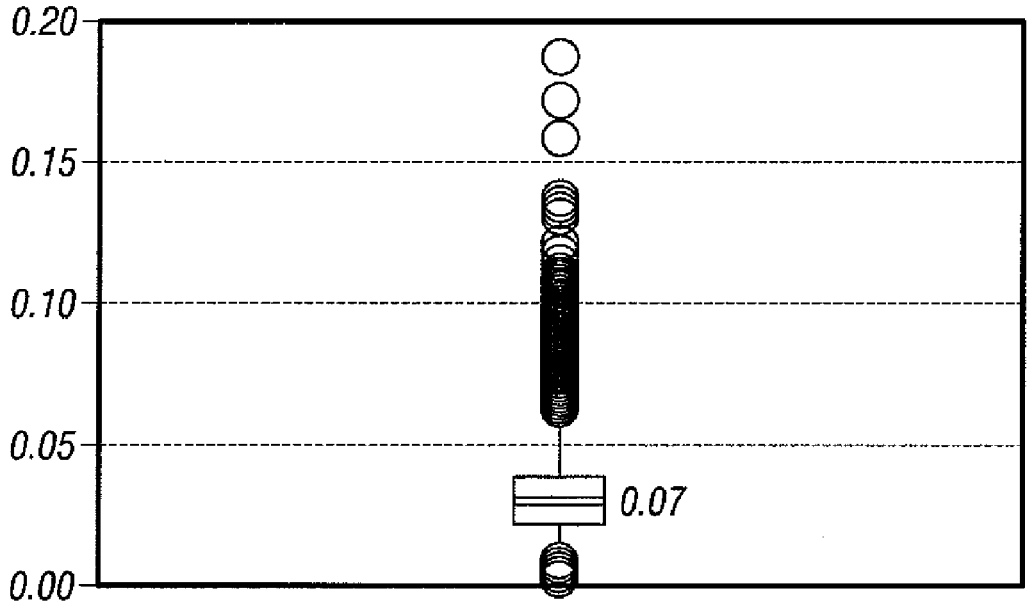
Figure 11B:
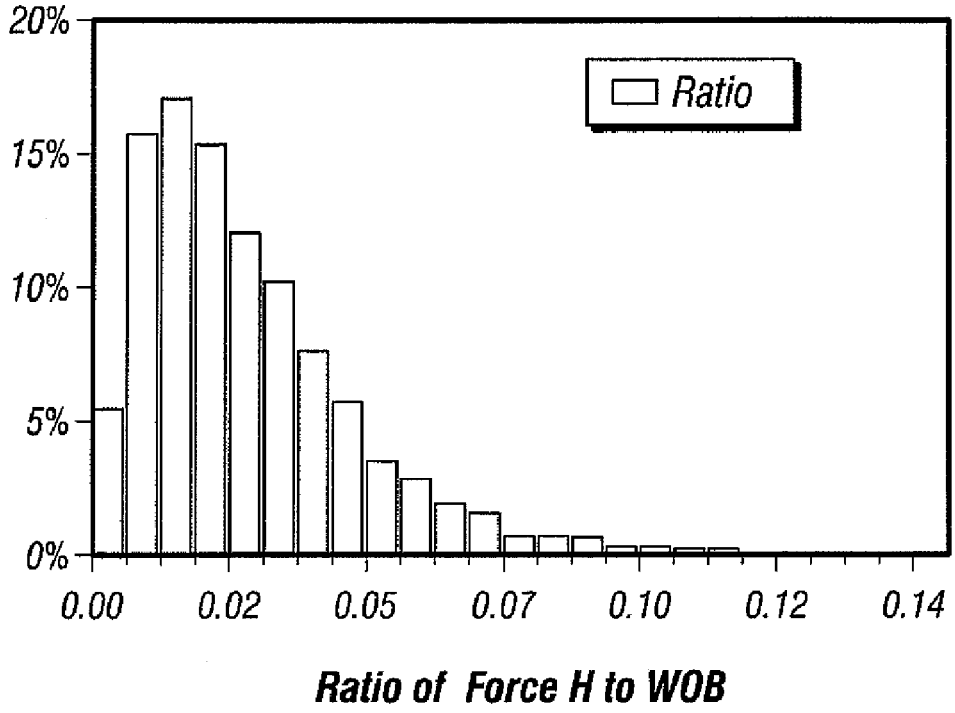

Then, a simulation is obtained for the second bit design and the resultant radial forces are obtained as plots from the simulation. FIGS. 9B, 10B, and 11B show three different output of a second bit design iteration. In comparison to FIG. 9A, FIG. 9B is also substantially, evenly distributed among the three cones. However, the magnitudes of the forces are substantially different, as indicated by the scale of the polar plot.

With respect to the box-whisker plot, FIG. 10B shows a the mean (or average) ratio of the resultant radial force to the applied weight on bit during the first iteration is 0.03, i.e., the resultant radial force is 3.0% of the applied weight on bit. The standard deviation of the bit during the second iteration shows the resultant radial force is approximately between 1% and 4% of the applied weight on bit. Further, the maximum value of the resultant radial force is approximately 18% of the applied weight on bit.

The chart plot in FIG. 11B shows the most frequently occurring ratio is about 0.010, which correlates to about 17% of the time, spent drilling. In other words, the resultant radial force exerted by the bit is approximately 1.0% of the applied weight on bit for about 17% of the time spent drilling. Therefore, FIGS. 10B and 11B show improvement with respect to selected criteria, namely, the ratio between the resultant radial force and the applied WOB.

Figure 9C:
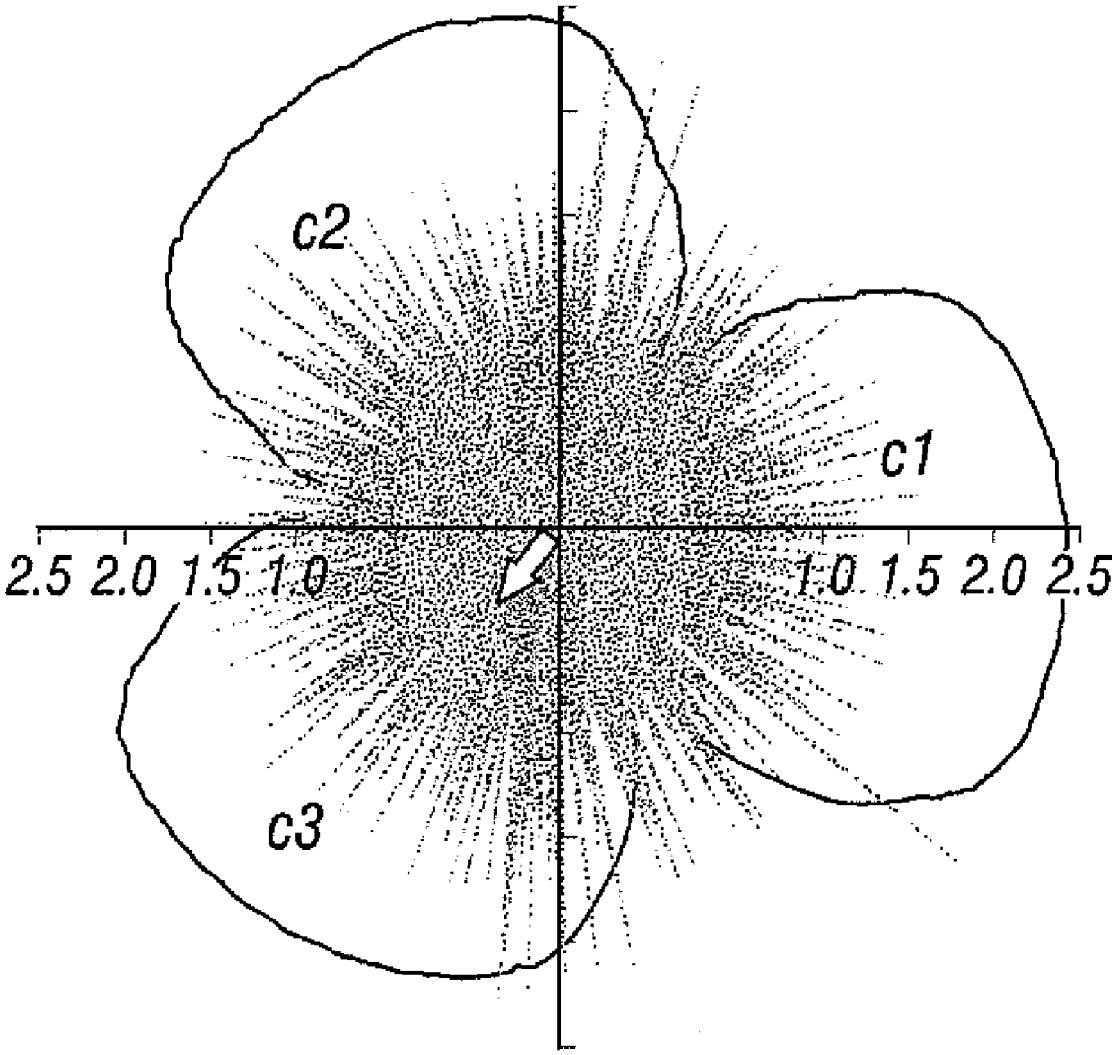

After reviewing the plots, the designer finds that the quantitative radial force criteria has been satisfied. However, with respect to a "qualitative" radial force criteria that is applied by the designer through a visual analysis of the polar plot distribution of radial forces, the designer determines that the design may be improved further. Accordingly, the designer may further modify the bit design by changing one or more drill bit design parameters, and thereby, generating a third bit design. An adjustment is made, and the third design is simulated, and the lateral forces are obtained from the simulation in the form of a radial plot, a box-whisker plot, and a chart plot. In FIG. 9C, the resultant radial forces are evenly distributed. Moreover, the magnitude of the radial forces has been significantly reduced by the design change. Referring to FIG. 9B, for example, the axis ranges from 0 to 6, however, in FIG. 9C, the axis ranges from 0 to 2.5. This indicates that the distances between the vectors and the origin is substantially less, i.e., the magnitude of the resultant radial forces are substantially less.

Figure 10C:
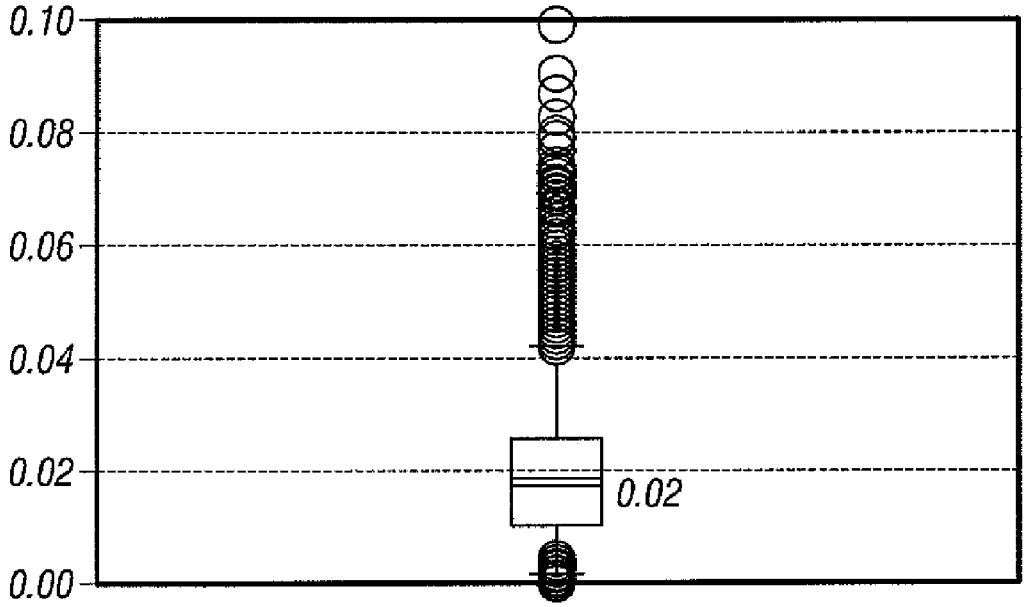

As for FIG. 10C, the mean (or average) ratio of the resultant radial force to the applied weight on bit during the first iteration is 0.02, i.e., the resultant radial force is 2.0% of the applied weight on bit. The standard deviation of the bit during the second iteration shows the resultant radial force is approximately between 0% and 2.5% of the applied weight on bit. Further, the maximum value of the resultant radial force is approximately 10% of the applied weight on bit.

Figure 11C:
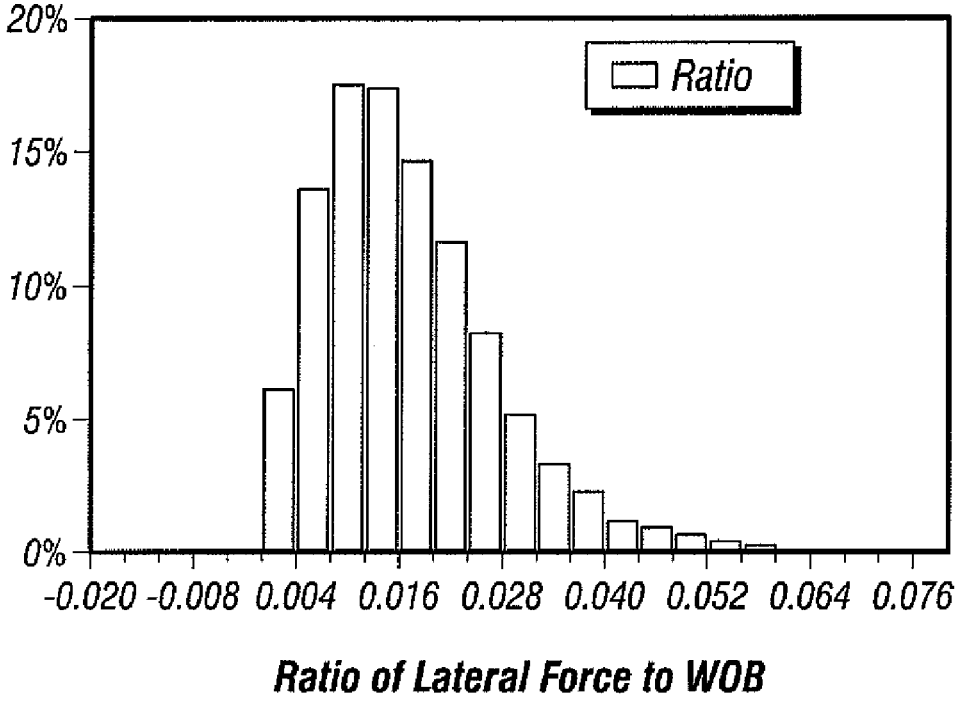

The chart plot in FIG. 11C shows the most frequently occurring ratio is about 0.010, which correlates to about 17% of the time, spent drilling. In other words, the resultant radial force exerted by the bit is approximately 1.0% of the applied weight on bit for about 17% of the time spent drilling. However, two important distinctions are the average resultant force occurs more frequently and the maximum force is substantially less. Therefore, FIGS. 10C and 11C show substantial improvement with respect to the ratio of the resultant radial force to the applied WOB and the third drill bit design is selected.

Figure 14:
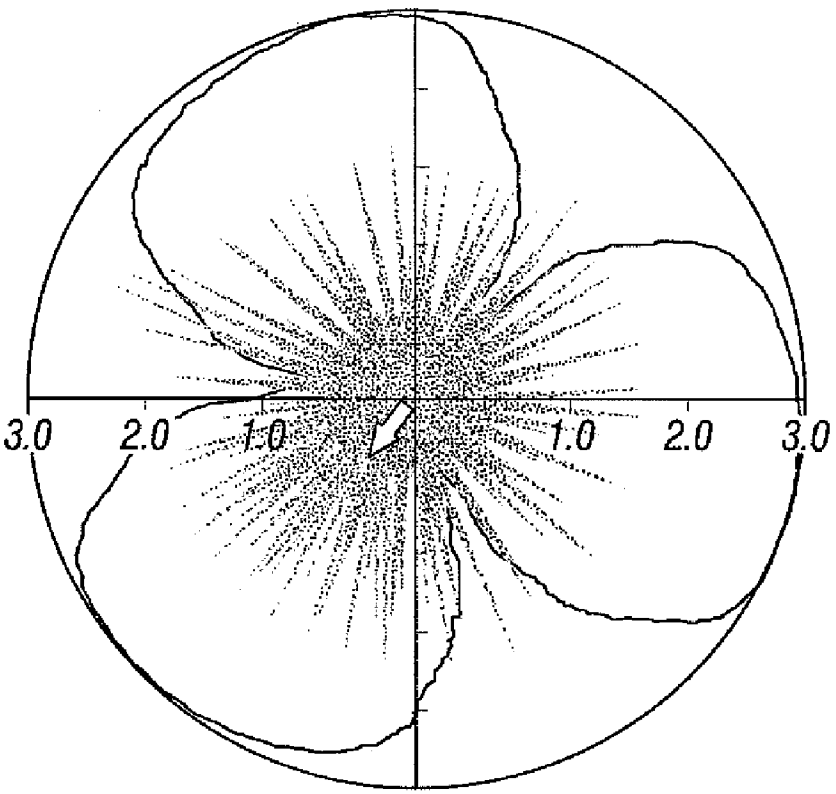
FIG. 14 shows an exemplary distribution polar plot of radial force for a bit design without a skewed distribution in accordance with an embodiment of the present invention.

In the above example, the radial force plots show substantially even distribution of resultant radial forces. However, FIGS. 13 and 14 contrast a skewed versus unskewed distribution of radial forces in a radial force plot. For example, in FIG. 13, the outlying radial forces are substantially even among the three cones. In contrast, in FIG. 14, the outlying radial forces are concentrated on the lower, left cone. Therefore, the bit design in FIG. 14 results in the lower, left cone having a propensity to fail before the other cones. In the present invention, a criteria is applied such that distribution among cones must be substantially even. This may advantageously minimize bit whirl and result in an improved ROP for the bit. Adjustments can be made to the bit design until an even distribution of radial forces is achieved.

Designing Bottomhole Assembly

Figure 15:
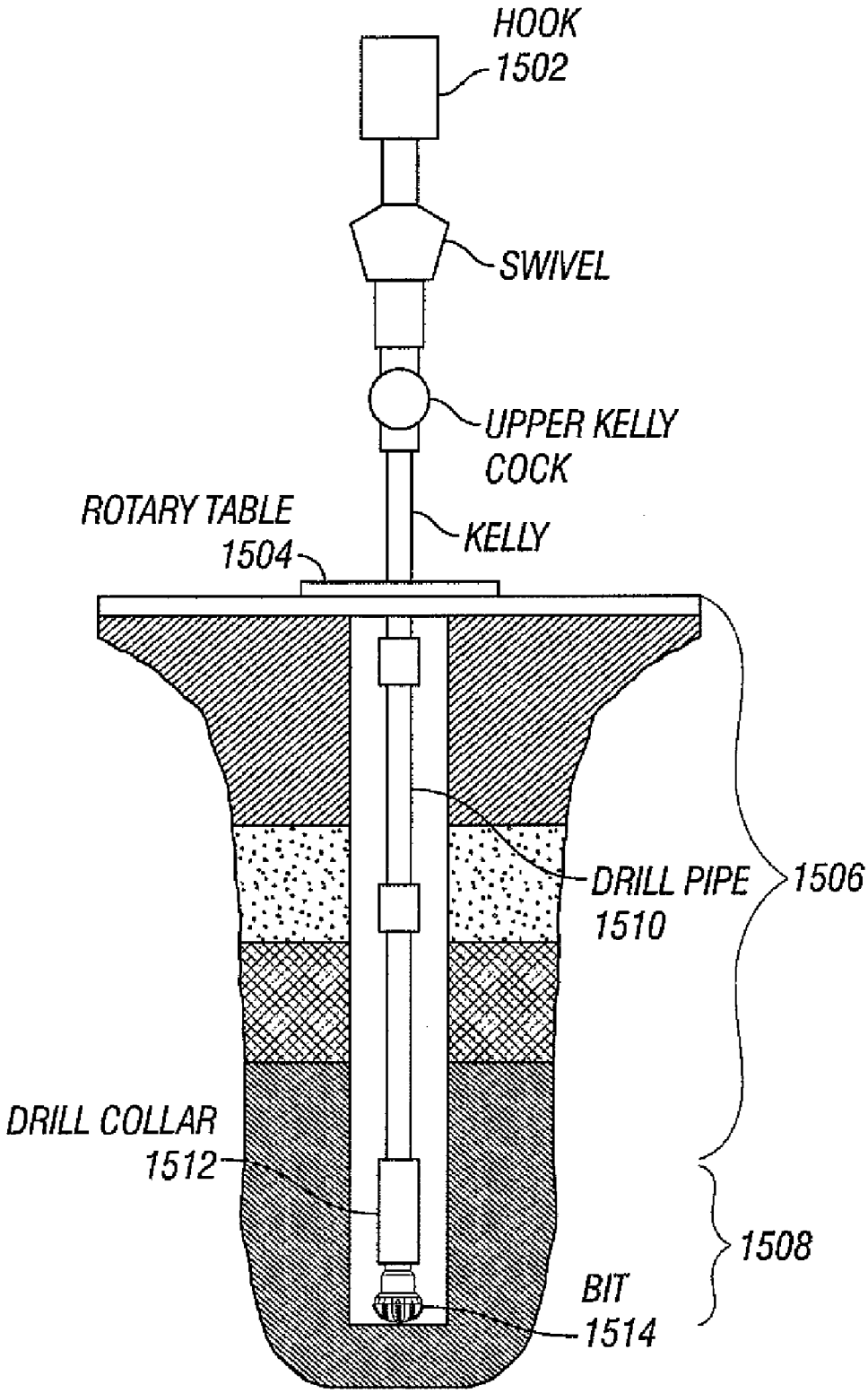
FIG. 15 shows an example of a drilling tool assembly in accordance with an embodiment of the present invention.

In view of the description above, one of ordinary skill in the art will appreciate that a method for simulating an entire drilling tool assembly may also be used to obtain the resultant radial forces for a drill bit during drilling. Similarly, the above design method may also be used to design a drilling tool assembly. The drilling tool assembly may further include the entire bottomhole assembly (BHA), which may include a drill bit, or an entire drill string, including a string of drill pipe, a BHA and a drill bit. As shown in FIG. 15, a drilling tool assembly 1500 is suspended from a hook 1502 and rotated by a rotary table 1504. The drilling tool assembly 1500 comprises a drill string 1506 and BHA 1508. The drill string 1506 comprises a plurality of joints of drill pipe 1510. The BHA 1508 comprises a drill collar 1512 and a drill bit 1514. The drill bit 1514 shown in this example is a roller cone drill bit. In other embodiments any type of drill bit may be used.

Alternatively, or in addition to modifying drill bit design parameters, drilling tool assembly design parameters may be modified in accordance with an embodiment of the present invention. The drilling tool assembly design parameters modified may be, for example, BHA design parameters. Such methods may be extremely useful in the design of drilling tool assemblies for selected bits and formations. While the magnitude of the resultant forces will tend to be larger than those obtained by simulations of only the drill bit, the general designs method described above is applicable.

Figure 16:
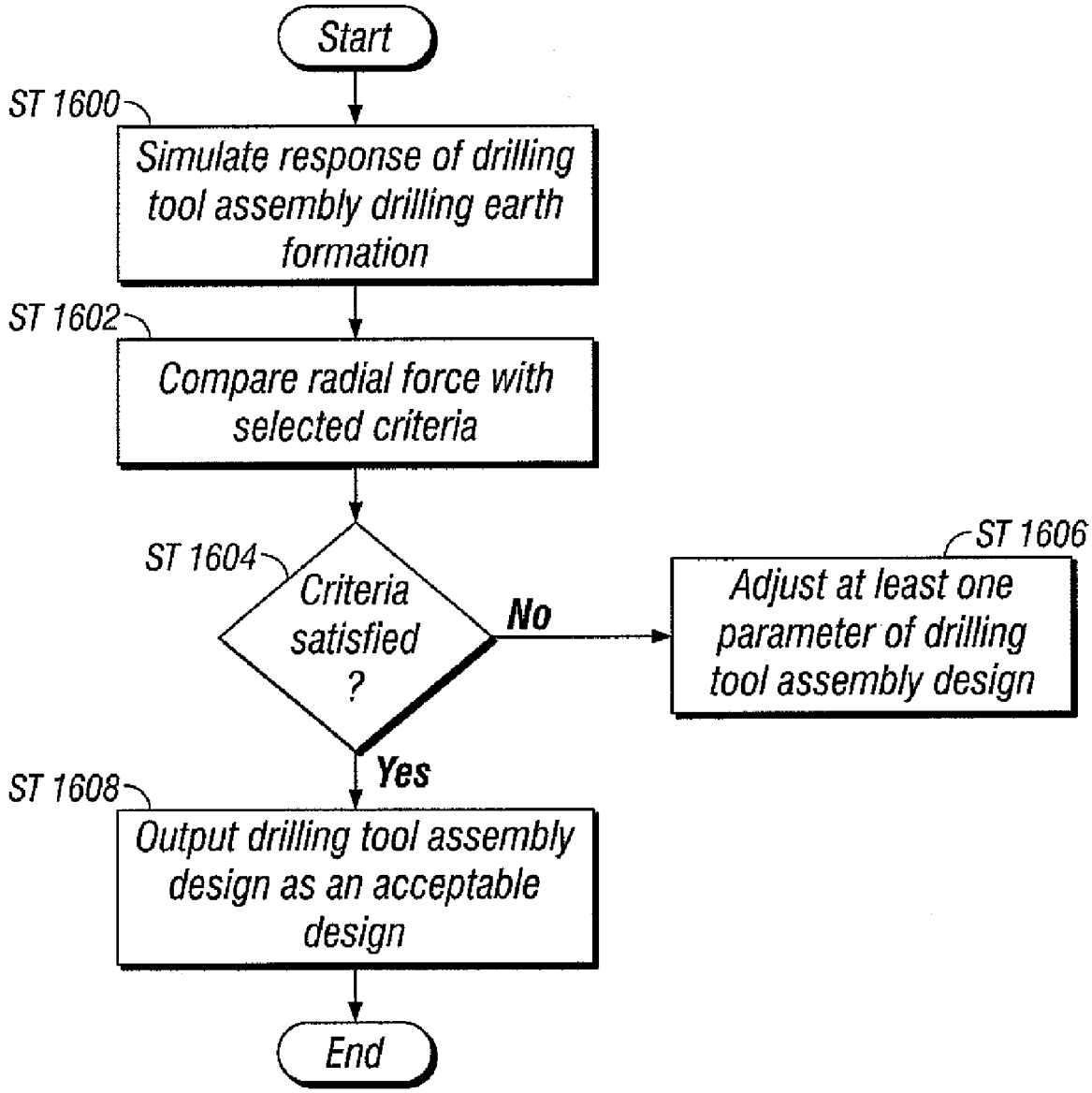
FIG. 16 shows a flow diagram of a method of designing a bottomhole assembly in accordance with an embodiment of the present invention

One embodiment of the present invention will now be described with respect to FIG. 16. The method includes simulating a response of a drilling tool assembly drilling in the earth formation (Step 1600). A simulation method that may be used to simulate the dynamic response of a drilling tool assembly is disclosed in U.S. patent application Ser. No. 09/689,299 filed on Oct. 11, 2000, entitled, "Simulating the Dynamic Response of a Drilling Tool Assembly and its Application to Drilling Tool Assembly Design Optimization and Drilling Performance Optimization," assigned to the assignee of the present invention and incorporated herein by reference in its entirety. The resultant radial forces obtained from a simulation as described in the above patent may be presented in a graphical form similar to that shown in FIGS. 5, 7, and 9A.

The method further includes comparing resultant radial force in view of a selected criteria (Step 1602). Examples of comparing a resultant radial force to a selected criteria have been previously described above with respect to method shown in FIG. 4. If the selected criteria is satisfied (Step 1604), then the drilling tool assembly design is output as an acceptable design (Step 1608). However, if the selected criteria is not satisfied (Step 1604), then at least one parameter of the drilling tool assembly design is adjusted (Step 1606) and the simulation of the drilling tool assembly is repeated at Step

1600. In this embodiment, the design method continues until the selected criteria is satisfied or until the design method is terminated by the designer.

Designing Fixed Cutter Drill Bits

Additionally, one of ordinary skill in the art will appreciate that design methods in accordance with the present invention may also be used to design or selected fixed cutter drill bits (including, PDC drill bits, diamond impregnated bits, and bi-centered bits, and other eccentric bits). For example, referring to FIG. 16, the drilling tool assembly may comprise a fixed cutter drill bit. A method that may be used to obtain a response of a fixed cutter bit is disclosed in U.S. Provisional Application No. 60/485,642 filed on Jul. 9, 2003, entitled, "Methods for Modeling, Designing, and Optimizing Fixed Cutter Bits," assigned to the assignee of the present invention and incorporated herein by reference in its entirety. Using this method, the response of a fixed cutter bit of selected design drilling in a selected earth formation may be obtained and a selected criteria applied. If the design does not satisfy the selected criteria a design parameter of the drill bit may be adjusted, such as the location of one or more cutting elements, the geometry of the cutting elements or the back of side rake angles of one or more cutters, and the simulation and evaluation is repeated. The design method may be repeated until a drill bit design is obtained that satisfies the selected criteria. Alternatively, the design method may be terminated by a designer, the criteria adjusted, and the evaluation repeated as desired until a drill bit design satisfying a selected criteria is obtained.

Advantages of embodiments of the present invention may include one or more of the following. In one or more embodiments, the present invention may be used to minimize radial force imbalance that may result in a whirl effect and reduces cutting efficiency of a drill bit. Embodiments of the present invention can potentially increase the life of the bit by preventing damage due to repetitive impact of the cutting structure against the walls of the wellbore during drilling. Further, embodiments of the present invention may be adapted or use with any simulation method that can be adapted to output radial force data determined during a simulation.

Specific embodiments of the invention have been described in detail with reference to the accompanying figures. Numerous specific details have been set forth in order to provide a more thorough understanding of the invention. However, it will be apparent to one of ordinary skill in the art that the invention may be practiced without these specific details. In other instances, well known features, or features disclosed in detail documents referenced and incorporated herein by reference have not been described in detail to avoid obscuring the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for designing a drill bit, comprising:

determining radial forces acting on a selected drill bit during simulated drilling;

summing magnitudes of the radial forces with respect to a direction to generate a sum of the radial forces;

comparing the sum of the radial forces to an applied weight on bit;

generating a ratio between the sum of the radial forces and the applied weight on bit;

adjusting at least one parameter of the selected drill bit based on the generated ratio until the magnitude of the radial forces remains at a value less than a predetermined value for a duration of a preselected amount of time during simulated drilling; and outputting a drill bit design based on the generated ratio and the adjusting.

2. The method of claim 1, wherein the at least one parameter comprises at least one selected from the group consisting of a performance parameter, an environment parameter, and a simulation parameter.

3. The method of claim 2, wherein the performance parameter comprises drilling parameters.

4. The method of claim 2, wherein the environment parameter comprises cutting element interaction data and bottom hole geometry data.

5. The method of claim 1, wherein the determining the radial forces comprises:

rotating the selected drill bit;

calculating a new location of a cutting element on the selected drill bit;

determining an interference between the cutting element and an earth formation at the new location; and calculating a radial force acting on the earth formations based on the interference at the new location.

6. The method of claim 1, wherein the selected drill bit is a roller cone drill bit.

7. The method of claim 6, wherein bit design parameters of the selected drill bit comprise at least one selected from the group consisting of a cone profile, a cone axis offset, a number of cutting elements on each cone, a location of a cutting element of the selected drill bit, a size of a cutting element of the selected drill bit, a shape of a cutting element of the selected drill bit, and an orientation of a cutting element of the selected drill bit.

8. The method of claim 1, wherein the selected drill bit is a fixed cutter drill bit.

9. The method of claim 8, wherein bit design parameters of the selected drill bit comprise at least one selected from the group consisting of a cutter location, a cutter orientation, a cutter size, a cutter shape, and a cutter bevel size, a bit profile, a bit diameter, a number of blades on the selected drill bit, a blade geometry, a blade location, a junk slot area, and a bit axial offset.

10. The method of claim 1, wherein the ratio of the sum of the radial forces to the applied weight on bit is less than or equal to 0.20.

11. The method of claim 1, wherein the ratio of the sum of the radial forces to the applied weight on bit is less than or equal to 0.10.

12. The method of claim 1, wherein the ratio of the sum of the radial forces to the applied weight on bit is less than or equal to 0.05.

13. The method of claim 1, wherein the simulated drilling comprises dynamic simulation.

14. The method of claim 1, wherein the evaluating the radial forces comprises:

plotting magnitudes of the radial forces with respect to at least one selected from the group consisting of a direction of force, a frequency of occurrence, and time, to generate a radial force plot.

15. The method of claim 14, wherein the radial force plot comprises a polar plot of the magnitudes and directions of the resultant radial forces.

16. The method of claim 15, wherein the polar plot indicates that the resultant radial forces are less than a predetermined value for a selected percentage of the time during the simulated drilling.

17. The method of claim 16, wherein the selected percentage of the time during the simulated drilling is 70%.

18. The method of claim 14, wherein the radial force plot comprises a chart plot of the resultant radial force.

19. The method of claim 18, wherein the chart plot indicates that the radial resultant forces are less than a predetermined value for a selected percentage of the time during the simulated drilling.

20. The method of claim 19, wherein the selected percentage of the time during the simulated drilling is 70%.

21. The method of claim 14, wherein the radial force plot comprises a box-whisker plot of the resultant radial forces.

22. The method of claim 21, wherein the box-whisker plot indicates that the resultant radial forces are less than a predetermined value for a selected percentage of the time during simulated drilling.

23. The method of claim 22, wherein the selected percentage of the time during the simulated drilling is 70%.

24. A method for designing a bottomhole assembly, comprising:

determining radial forces acting on a bottom hole assembly during simulated drilling, said bottom hole assembly including a drill bit;

summing magnitudes of the radial forces with respect to a direction to generate a sum of the radial forces;

comparing the sum of the radial forces to an applied weight on bit;

generating a ratio between the sum of the radial forces and the applied weight on bit;

adjusting at least one parameter of the bottom hole assembly based on the generated ratio until the generated ratio remains at a value less than a predetermined value for a duration of a preselected amount of time during simulated drilling; and outputting a bottom hole assembly design based on the generated ratio and the adjusting.

25. The method of claim 24, wherein the graphically displaying occurs in real time.

26. The method of claim 24, wherein the evaluating the radial forces comprises:

plotting a magnitude of the radial forces with respect to at least one selected from a group of direction of force, frequency of occurrence, time, to generate a radial force plot.

27. The method of claim 26, wherein the radial force plot comprises a polar plot of the magnitudes and directions of the resultant radial forces.

28. The method of claim 27, wherein the polar plot indicates that the resultant radial forces are less than a predetermined value for a selected percentage of the time during the simulated drilling.

29. The method of claim 28, wherein the selected percentage of the time during the simulated drilling is 70%.

30. The method of claim 26, wherein the radial force plot comprises a chart plot of the resultant radial force.

31. The method of claim 30, wherein the chart plot indicates that the radial resultant forces are less than a predetermined value for a selected percentage of the time during the simulated drilling.

32. The method of claim 31, wherein the selected percentage of the time during the simulated drilling is 70%.

33. The method of claim 26, wherein the radial force plot comprises a box-whisker plot of the resultant radial forces.

34. The method of claim 33, wherein the box-whisker plot indicates that the resultant radial forces are less than a predetermined value for a selected percentage of the time during simulated drilling.

35. The method of claim 34, wherein the selected percentage of the time during the simulated drilling is 70%.

36. The method of claim 24, further comprising adjusting bit design parameters.

37. The method of claim 36, wherein the bottomhole assembly comprises a roller cone drill bit; and wherein the bit design parameters comprise at least one of a group consisting of a cone profile, a cone axis offset, a number of cutting elements on each cone, a location of a cutting element of the drill bit, a size of a cutting element of the drill bit, a shape of a cutting element of the drill bit, and an orientation of a cutting element of the drill bit.

38. The method of claim 36, wherein the bottomhole assembly comprises a fixed cutter drill bit; and wherein the bit design parameters comprise at least one of a group consisting of a cutter location, a cutter orientation, a cutter size, a cutter shape, and a cutter bevel size, a bit profile, a bit diameter, a number of blades on the bit, a blade geometry, a blade location, a junk slot area, and a bit axial offset.

39. The method of claim 24, wherein the simulated drilling comprises dynamic simulation.

* * * * *